US006247654B1

(12) United States Patent
Kuo

(10) Patent No.: US 6,247,654 B1
(45) Date of Patent: Jun. 19, 2001

(54) SPRINKLER STRUCTURE INCLUDING A FOGGY WATER SPRAY

(76) Inventor: Wen-Li Kuo, No. 10, Fang Dong Road, Wen Chin Tsun, Fang Yuan Hsiang, Chang Hua Hsien (TW)

( * ) Notice: Subject to any disclaimer, the term of this patent is extended or adjusted under 35 U.S.C. 154(b) by 0 days.

(21) Appl. No.: 09/574,211

(22) Filed: May 19, 2000

(51) Int. Cl.[7] ..... A62C 31/00
(52) U.S. Cl. ..... 239/443; 239/526; 239/550
(58) Field of Search ..... 239/289, 436, 239/443, 396, 525, 526, 548, 550, 583

(56) References Cited

U.S. PATENT DOCUMENTS 4,909,443 * 3/1990 Takagi ..... 239/526
5,772,121 * 6/1998 Wang ..... 239/396
5,806,770 * 9/1998 Wang ..... 239/443
5,873,531 * 2/1999 Wang ..... 239/526
5,967,422 * 10/1999 Wang ..... 239/526

* cited by examiner

*Primary Examiner*—Lisa Ann Douglas
(74) *Attorney, Agent, or Firm*—Dougherty & Troxell

(57) ABSTRACT

The invention, an improved sprinkler structure equips a molded handle and sprinkler majority with internally connected waterways. A valve bar is inside the waterway with extension end extruded out of the majority and connects with a compression board through a screw. A valve opening with contracted diameter is located at the front end of waterway, thus a valve bar can block the valve opening to prevent water spraying from a water outlet. If a valve bar is compressed by a compression board to move backward, water will flow through a water outlet and enters the structure of a sprinkler. Especially, at the sprinkler majority near the side held by a user, a water outlet column connecting with internal waterway inside the sprinkler majority is equipped. A foggy water spray base, which is able to produce foggy water and control water flow is connected to the surrounding edge of the column. During the process of using a sprinkler, part of foggy water sprays against a user to achieve cool and comfortable effects as the characteristics of the invention.

2 Claims, 5 Drawing Sheets

SPRINKLER STRUCTURE INCLUDING A FOGGY WATER SPRAY

BACKGROUND OF THE INVENTION

1) Field of the Invention

The invention relates to an improved sprinkler structure to modify the defects found in traditional sprinklers. Especially, through the particular structural design for the invention, during the process of spraying water in a garden, the sprinkler sprays foggy water against a user from the side of the sprinkler facing the user. The invention is characterized as providing a cool and comforting effect for a user.

2) Description of the Prior Art

As shown in FIG. 1, currently there are various structural types of sprinklers 2 on the market. The structure is mainly comprised of molded handle 21 and a sprinkler 22 with internally connected waterways 23. A valve bar 24 inside the water has an extension end 27 extruded out of the sprinkler 22 and is connected with compression board 25 by a screw. A valve opening 26 with a contracted diameter is located at the front end of waterway 23. Thus, valve bar 24 can block valve opening 26 to prevent water spraying from water outlet 29. If valve bar 24 is compressed by compression board 25 and moves backward, water in waterway 23 will flow through water outlet 29 and will spray from water outlet 29.

For all the various types of sprinkler products, through the compression of compression board 25, valve bar 24 on sprinkler 2 is forced to move backward, thus water is able to pass through waterway 23 and water outlet 29 and finally sprays from water outlet 29. During the application process, water is directly sprayed from water outlet 29 on sprinkler head 28 of sprinkler 2.

However, sprinkler 2 is mainly utilized in common outdoor gardening. The plant in a garden must be constantly sprayed with water, especially during sunny days. Usually, water spraying is carried on outdoors and in sunny conditions. Thus, during the water spraying process, a user must also bear sunshine, which is a tedious task for a user.

Therefore, on the basis of the above defects for traditional sprinklers to be overcome, the inventor researched product improvement according to tremendous sales, fabrication, and assembly experience in various gardening and water supply hardware together with consumer reply and personal experience. With the accumulated yearly experience and study results, the inventor developed this invention.

SUMMARY OF THE INVENTION

The primary objective of the invention is to provide an improved structure for a sprinkler having a molded handle and sprinkler with internally connected waterways. A valve bar inside the waterway has an extension end extruded out of the sprinkler and connects with a compression board through a screw. A valve opening with a contracted diameter is located at the front end of the waterway. Thus, the valve bar can block the valve opening to prevent water spraying from the water outlet. If the valve bar is moved backward by a compression board, water will flow through the water outlet. The sprinkler has, near the side held by a user, a water outlet column connected with the internal waterway inside the sprinkler. A foggy water spray base, which is able to produce foggy water and control the water flow is connected to the surrounding edge of the column. During the process of using the sprinkler to spray water against the outdoor plant in common outdoor gardens, the front end of the sprinkler can not only spray water against the various plants, as common sprinklers, but also is able to spray foggy water against a user. The invention is characterized by providing cool and comfortable effects to the user during the water spraying process.

The following are brief descriptions of the illustration for optimal explanation of the invention.

DETAILED DESCRIPTION OF THE PREFERRED EMBODIMENT

Figure 1:
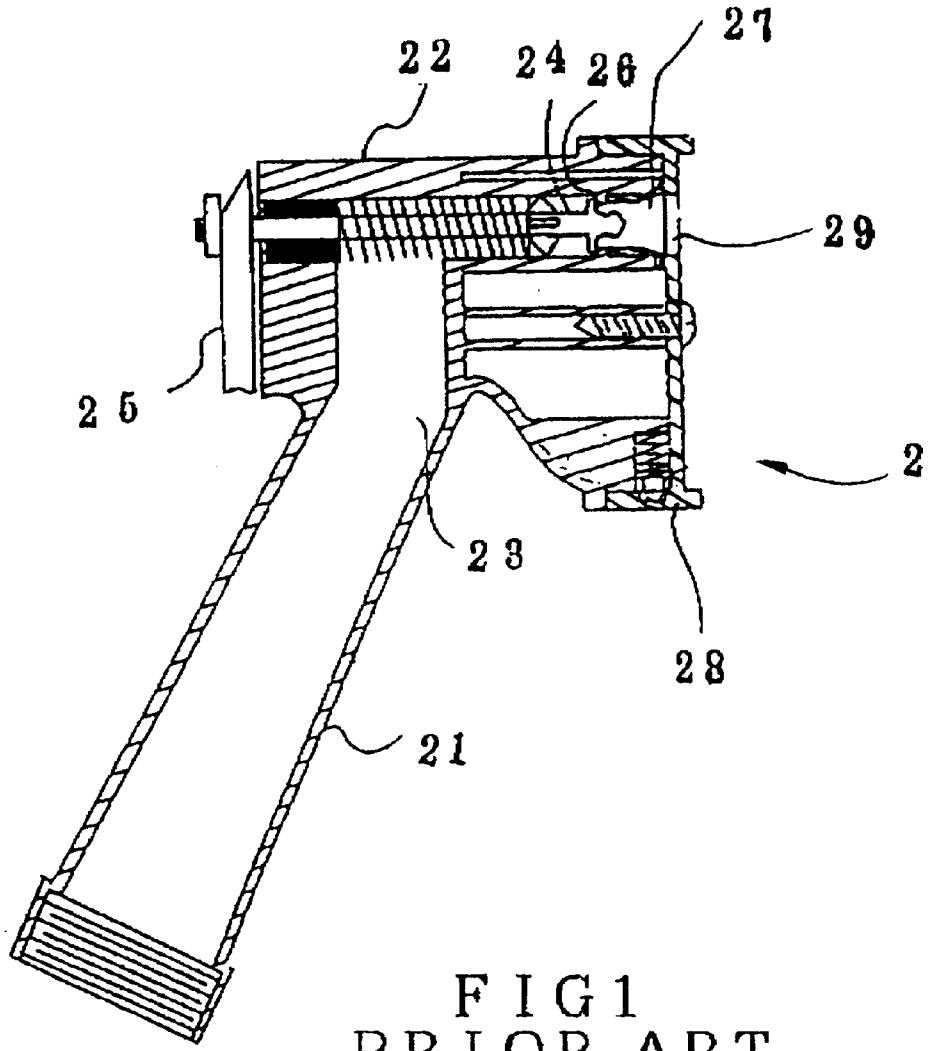
FIG 1 PRIOR ART
FIG. 1 is a cross-sectional drawing of a known sprinkler of the prior art.
Figure 2:
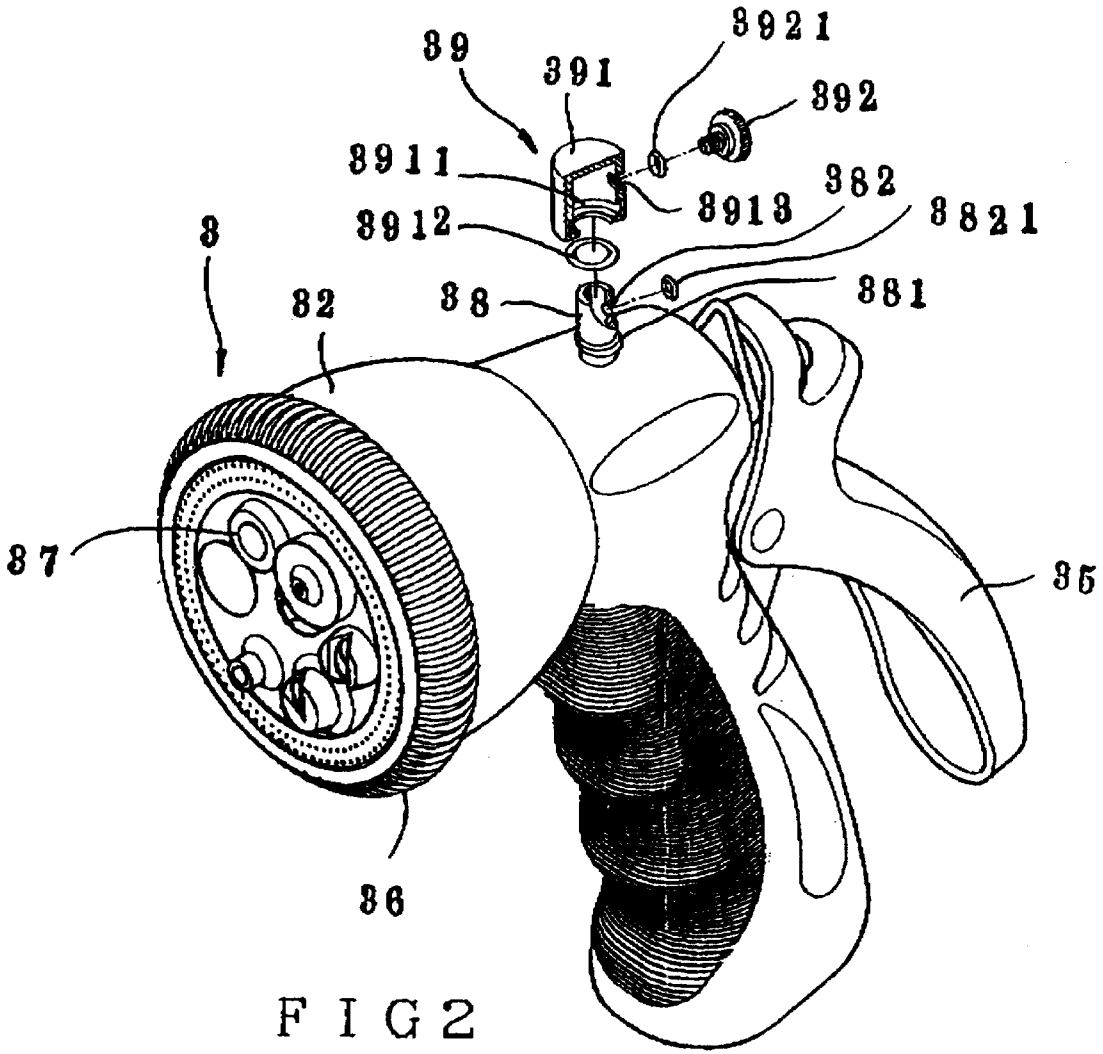
FIG. 2 is a partially exploded, perspective drawing of the invention.
Figure 3:
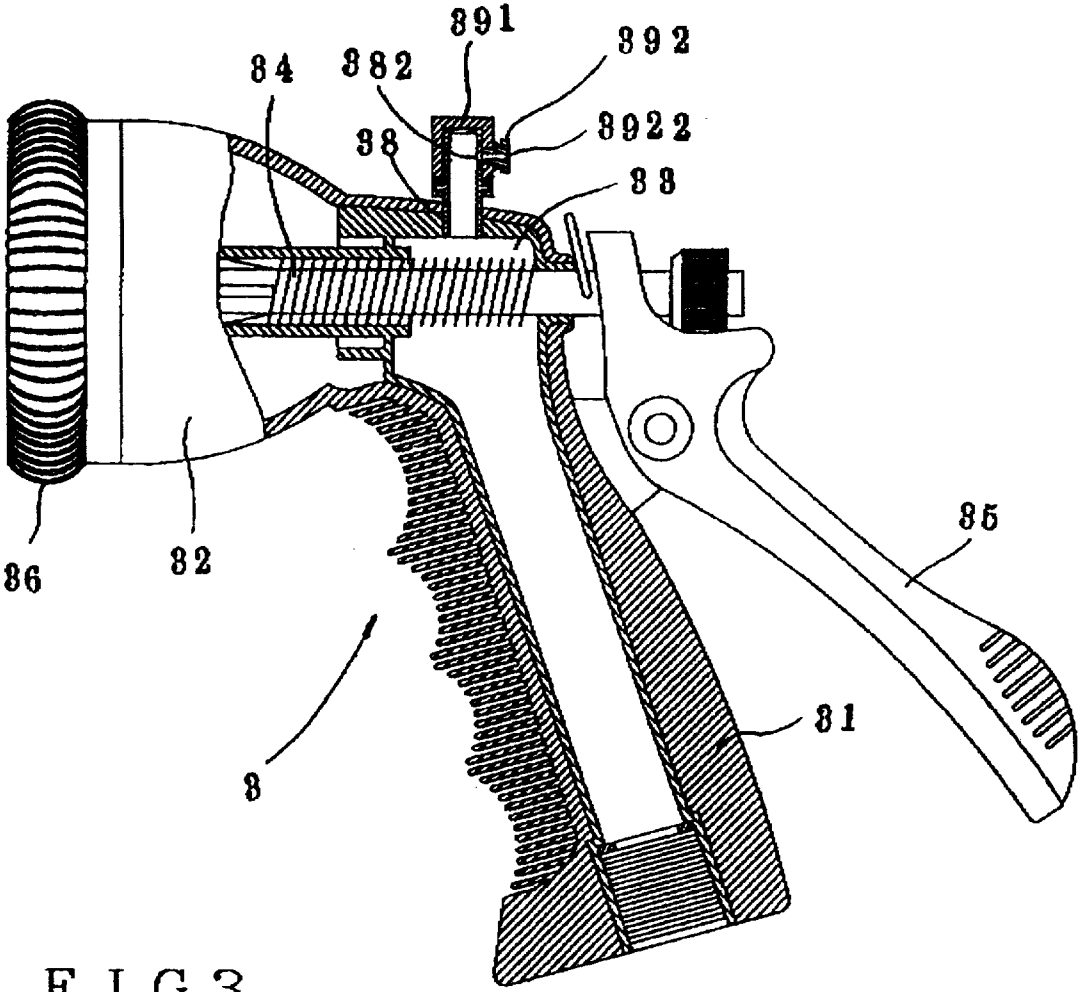
FIG. 3 is a cross-sectional drawing of the present invention showing the water outlet in a foggy water spray base and waterway fully connected.

First, please refer to FIGS. 2, 3, 4, and 5. The sprinkler structure for the invention is primarily comprised of molded handle 31 and sprinkler 32 with internally connected waterways 33. A valve bar 34 is inside waterway 33 with an extension end extruded out of sprinkler 32 and connected to compression board 35 through a screw. At the front end of waterway 33, there is a valve opening (which is not shown in the figures and is the same as common structure of prior art, thus is not further discussed). Thus, valve bar 24 can block the valve opening to prevent water in waterway 33 from spraying through the water outlet (which is not shown in the figures and is the same as common structure of prior art, thus is not further discussed). If valve bar 34 is moved backward by compression board 35, water in waterway 33 will flow through the water outlet and be sprayed from water outlet 37 on sprinkler head 36 of sprinkler 3. The main characteristics for the invention is to equip water outlet column 38 connecting with internal waterway 33 inside the sprinkler 32, near the side held by a user. On the bottom surrounding edge of water outlet column 38, there is interlock convex edge 381 and water stop ring 3821 on water outlet 382. Furthermore, water outlet column 38 is connected to interlock concave groove 3911 on the inter-lateral surrounding edge of revolving cap 391 to locate water stop ring 3912. Revolving cap 391 has joint hole 3913. Inside the foggy water spray base 392, there is foggy water spray hole 3922.

Figure 4:
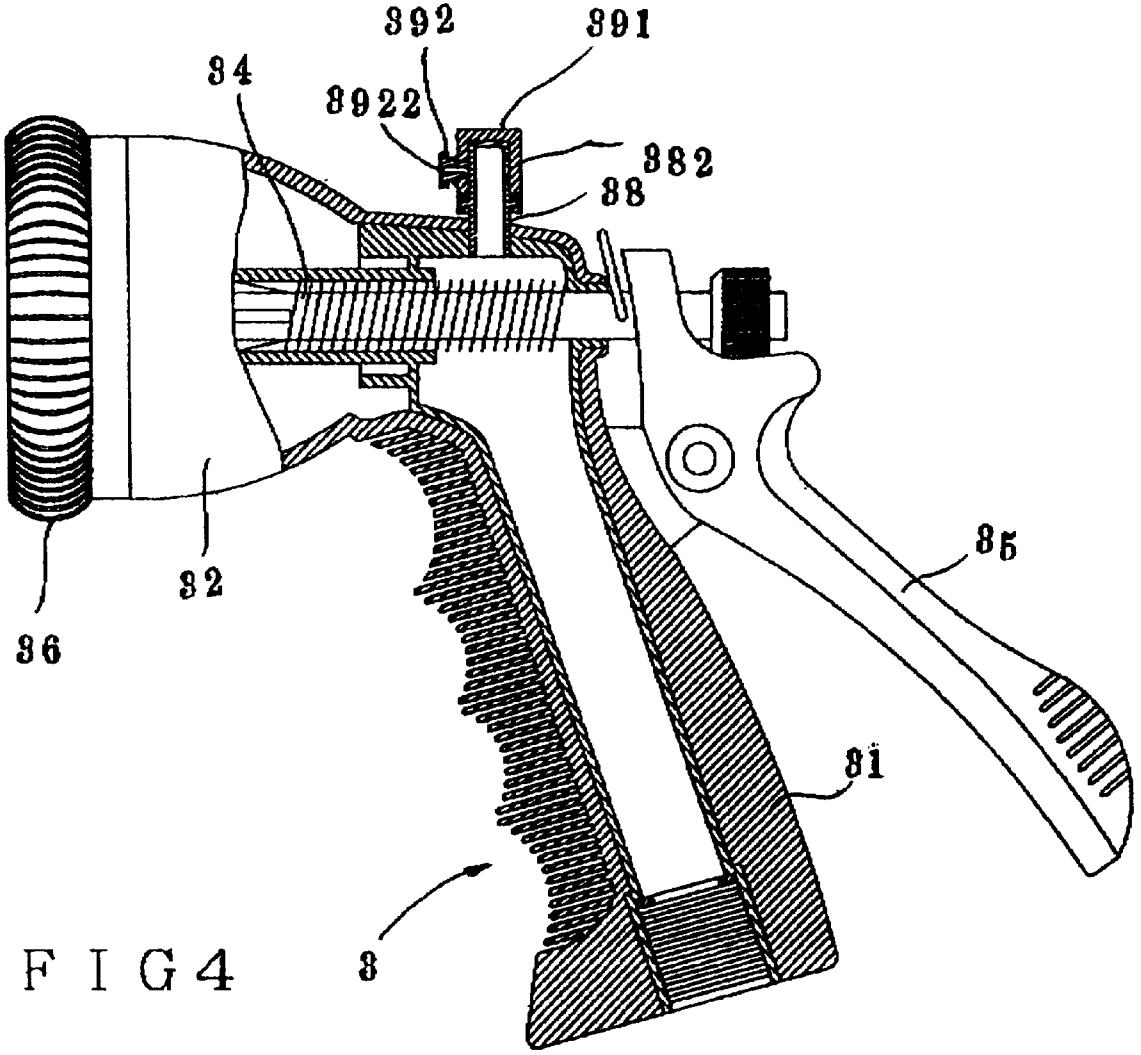
FIG. 4 is a cross-sectional drawing of the present invention showing the water outlet in a foggy water spray base and water disconnected.
Figure 5:
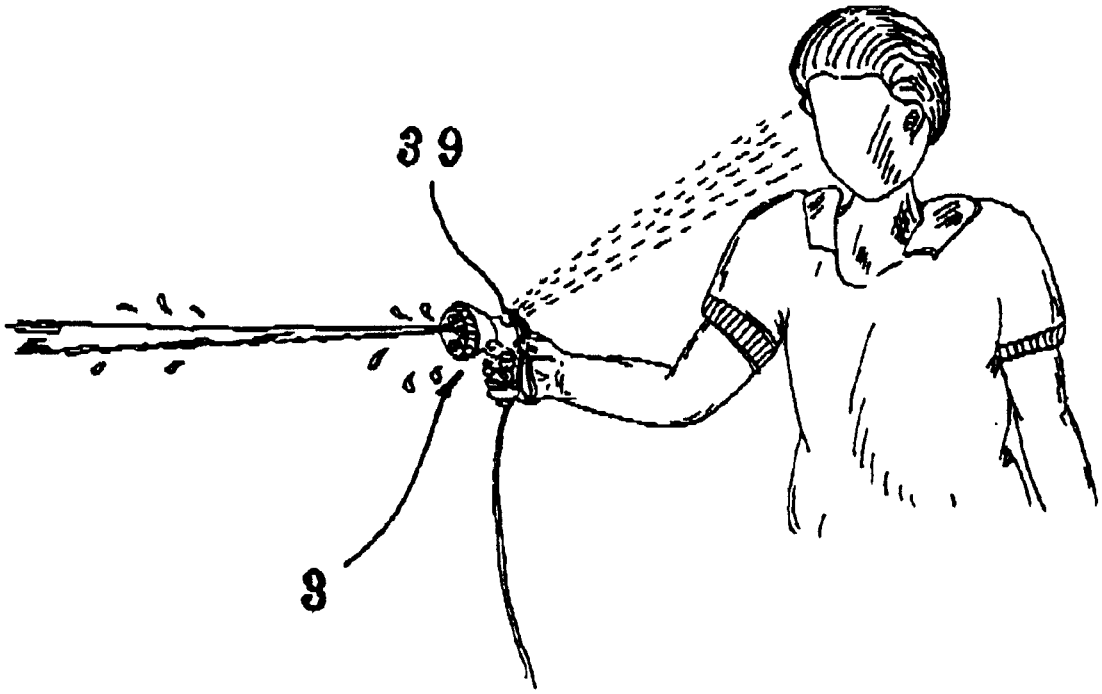
FIG. 5 is a pictorial drawing of the invention in use.

Through the above structural assembly, during the process of using the sprinkler to spray water in a garden, the front end of sprinkler 3 cannot only spray water to various kinds of plant like common sprinklers do, but also can simultaneously spray foggy water against a user from water outlet 392 through joint hole 3913. During water spraying process, it provides cool and comfortable effects to a user as shown in FIG. 5. Also, revolving cap 391 can be rotated anytime to separate joint hole 3913 on revolving cap 391 from water outlet 382 on water outlet column 38. Thus, as shown in FIG. 4, the foggy water will not spray against a user.

In summary, compared to the invention of prior art, the sprinkler of the invention sprays foggy water against a user to achieve cool and comfortable effects. The above explanation is a substantial embodiment of the invention, which provides greater practical performance than products of the prior art.

What is claimed is:

1. A sprinkler comprising a molded handle and a sprinkler portion with internally connected waterway; a valve bar inside the waterway with an extension end extruded out of the sprinkler portion and connecting with a compression board through a screw; a valve opening with a contracted diameter located in the sprinkler portion at a front end of the waterway, the valve bar normally blocking the valve opening to prevent water from spraying from a water outlet and, when the valve bar is moved backward by the compression board, enabling water to flow through the water outlet in a first direction; and, a water outlet column located on the sprinkler portion and connected with the waterway inside the sprinkler portion, the water outlet column including a foggy water spray base for spraying foggy water in a second direction different from the first direction, whereby during the process of using the sprinkler to spray water from the water outlet, foggy water is sprayed against a user to provide a cooling and comforting effect.

2. The sprinkler of claim 1 wherein the water outlet column further includes, on a bottom edge, an interlock convex edge with a water stop ring; and a revolving cap having the foggy water spray base and including an interlock concave groove on an inter-lateral surrounding edge joined with the interlock convex edge on the water outlet column; the foggy water spray base including a foggy water spray hole.

* * * * *